United States Patent [19]

Sievers

[11] 3,999,223

[45] Dec. 28, 1976

[54] FLUSH VALVE WITH SELECTED VOLUME CONTROL

[76] Inventor: William O. Sievers, 512 Milwaukee St., Denver, Colo. 80206

[22] Filed: Mar. 1, 1976

[21] Appl. No.: 662,881

Related U.S. Application Data

[63] Continuation-in-part of Ser. No. 605,646, Aug. 18, 1975, Pat. No. 3,940,805.

[52] U.S. Cl. ..... 4/67 A; 4/34; 4/67 R; 4/249

[51] Int. Cl.[2] ..... E03D 1/34; E03D 5/02; A61B 19/00

[58] Field of Search ..... 4/67 A, 67 R, 34, 249, 4/57 R, 57 P; 137/601

[56] References Cited

UNITED STATES PATENTS

| | | | |
|---|---|---|---|
| 3,406,940 | 10/1968 | Kertell | 4/34 X |
| 3,574,866 | 4/1971 | Sievers | 4/34 |
| 3,619,821 | 11/1971 | Bobo | 4/41 |
| 3,806,962 | 4/1974 | Sievers | 4/67 A |
| 3,902,201 | 9/1975 | Bobo | 4/41 |

*Primary Examiner*—Henry K. Artis
*Attorney, Agent, or Firm*—Wm. Griffith Edwards

[57] ABSTRACT

A dual capacity flush valve has a handle or actuator which is normally operated to provide a low volume flush; a selector member is positioned adjacent the handle and when operated enables the handle to be operated to provide a full capacity flush. The handle is moved in the same direction for both flush volumes. The valve handle actuates a valve member shown as a plate having one or more valve openings for controlling the flow of water, the plate being rotated by the handle to open the valve and then being rotated in the same direction by a water motor when the water flows through a plate opening. Rotation of the plate by the motor returns the valve to its closed position. The amount of opening of the valve determines the duration and capacity of the flush.

8 Claims, 6 Drawing Figures

FLUSH VALVE WITH SELECTED VOLUME CONTROL

This application is a continuation-in-part of my application Ser. No. 605,646 filed Aug. 18, 1975, now U.S. Pat. No. 3,940,805.

My invention relates to automatic valves for delivering selected quantities of liquid for the flushing of toilets and the like and particularly to an improved actuating arrangement for such valve.

My above copending application discloses and claims a valve control employing a valve plate or disc which is rotated through a different angle for each flush volume. The rotation of the plate is effected by a water motor driven by the flow of water when the valve is opened; when the water flows, the plate is turned until it shuts off the flow. In the embodiment of my invention disclosed in that application, the valve has an actuating handle which is moved in one direction for a low volume flush and in another direction for a full volume flush; the valve plate is moved in the same direction for both operations of the handle.

It is an object of my invention to provide a flush valve of the dual volume type including an improved arrangement for effecting the operation of the valve.

It is another object of my invention to provide an improved flush valve of the dual volume type and wherein the valve actuator is moved in the same direction for selecting either the high or the low flush volume.

It is another object of my invention to provide a flow control valve of the type having a control plate actuated by a water motor, including an improved actuating arrangement for controlling the initiation of the operation of the valve plate to select the volume of water delivered by the valve.

Briefly, in carrying out the objects of my invention in one embodiment thereof, I provide a two volume flush valve including a rotatable disc having at least one opening and which can be brought into position by an actuating handle to partially uncover the opening and start the water flowing. A water motor driven by the flow of water drives the disc until it closes the opening and shuts off the water. The actuator handle normally moves to a position which opens the valve relatively wide, so that water flows for a limited time to effect a low volume flush. A second control element may be actuated before the handle is operated, whereupon operation of the handle effects the full volume flush. When the second element is actuated, the handle opens the valve less, so that the water flows a longer time to close the valve, thus providing the full flush. The handle is moved in the same direction regardless of the quantity of flush water to be delivered.

The features of novelty which characterize my invention are pointed out with particularity in the claims annexed to and forming a part of this specification. My invention itself, however, both as to its organization and its manner of operation, together with further objects and advantages thereof, will best be understood upon reference to the following description taken in connection with the accompanying drawings in which:

Figure 1:
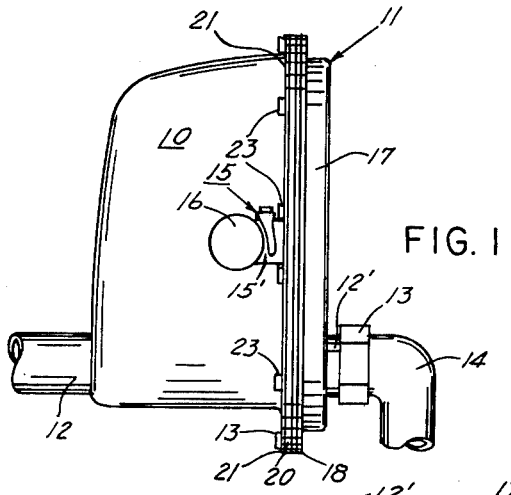
FIG. 1 is a side elevation view of a flush valve embodying my invention.
Figure 2:
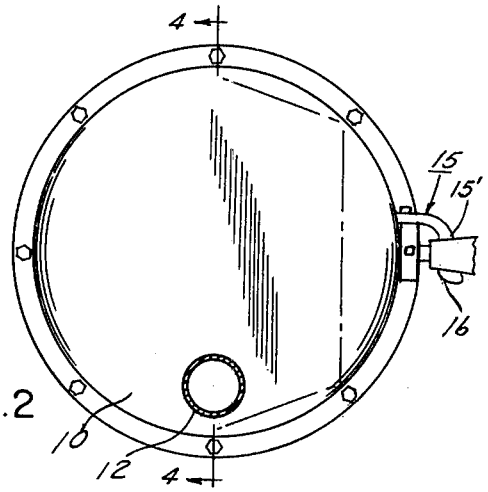
FIG. 2 is a rear elevation view of the valve.
Figure 3:
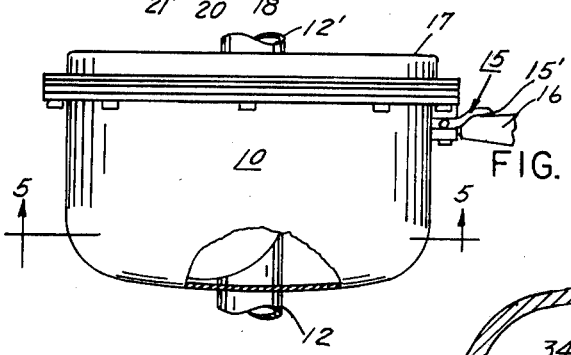
FIG. 3 is a top plan view of the valve partly broken away.

Referring now to the drawings, the dual flush valve shown in FIGS. 1, 2 and 3 comprises a housing 10 and a valve casing or capsule 11 securely mounted on a water supply pipe 12, the outlet from the valve being indicated at 12'; the outlet is connected through a coupling 13 to the input connection 14 of a plumbing fixture (not shown) which may be a toilet bowl. The valve is provided with an actuator handle 16 which is moved downwardly for both the high and low volume flushing operations, an auxiliary control 15 being operated with the handle for the high volume operation. The control 15 has a small handle or knob 15' at its outer end, which is adjacent the base of the handle 16, and this requires a conscious effort of the operator to effect a full volume flush. The capsule 11 includes a dished portion 17 having an outwardly extending flange 18 and a flat base or closure plate 20. The housing 10 is provided with an outwardly extending flange 21, and the flanges 18 and 21 with the outer periphery of the plate 20 therebetween are securely clamped together by bolts or machine screws 23. A sealing gasket 22 is provided between the flange 18 and the plate 20.

Figure 4:
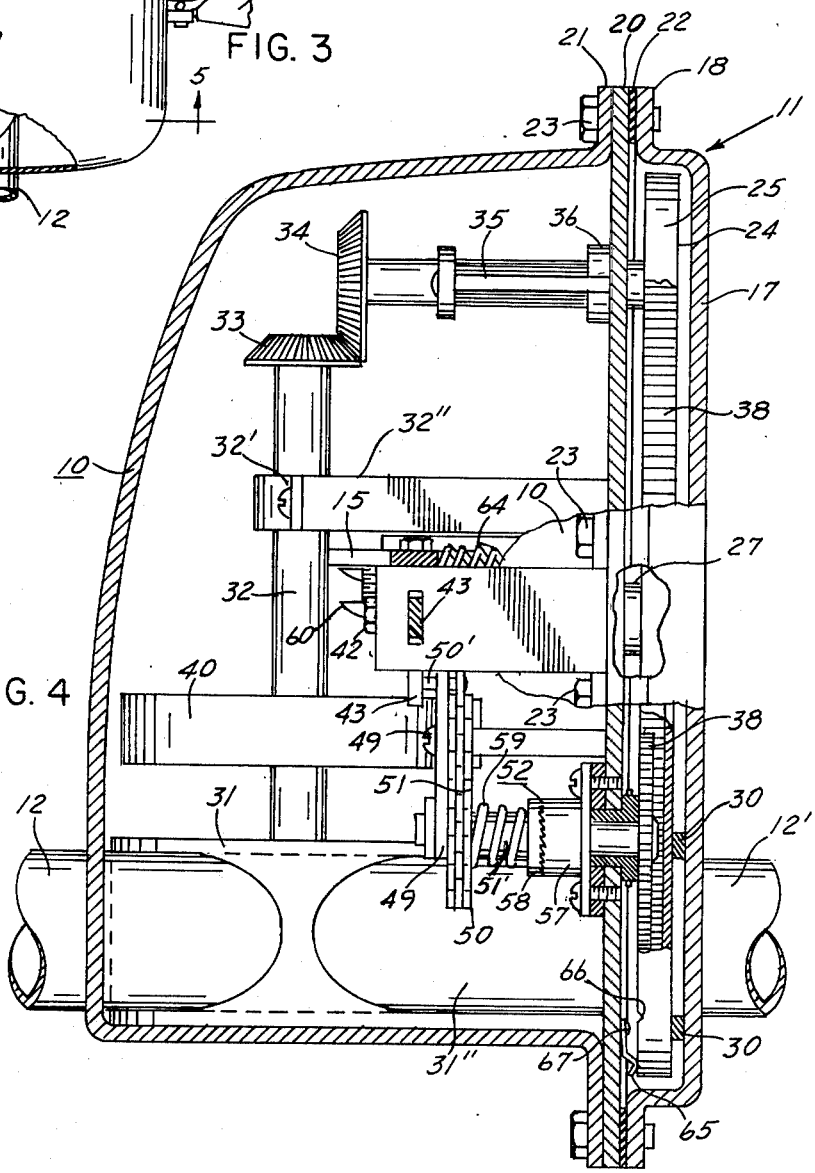
FIG. 4 is an enlarged sectional elevation view taken along the line 4—4 of FIG. 2.
Figure 5:
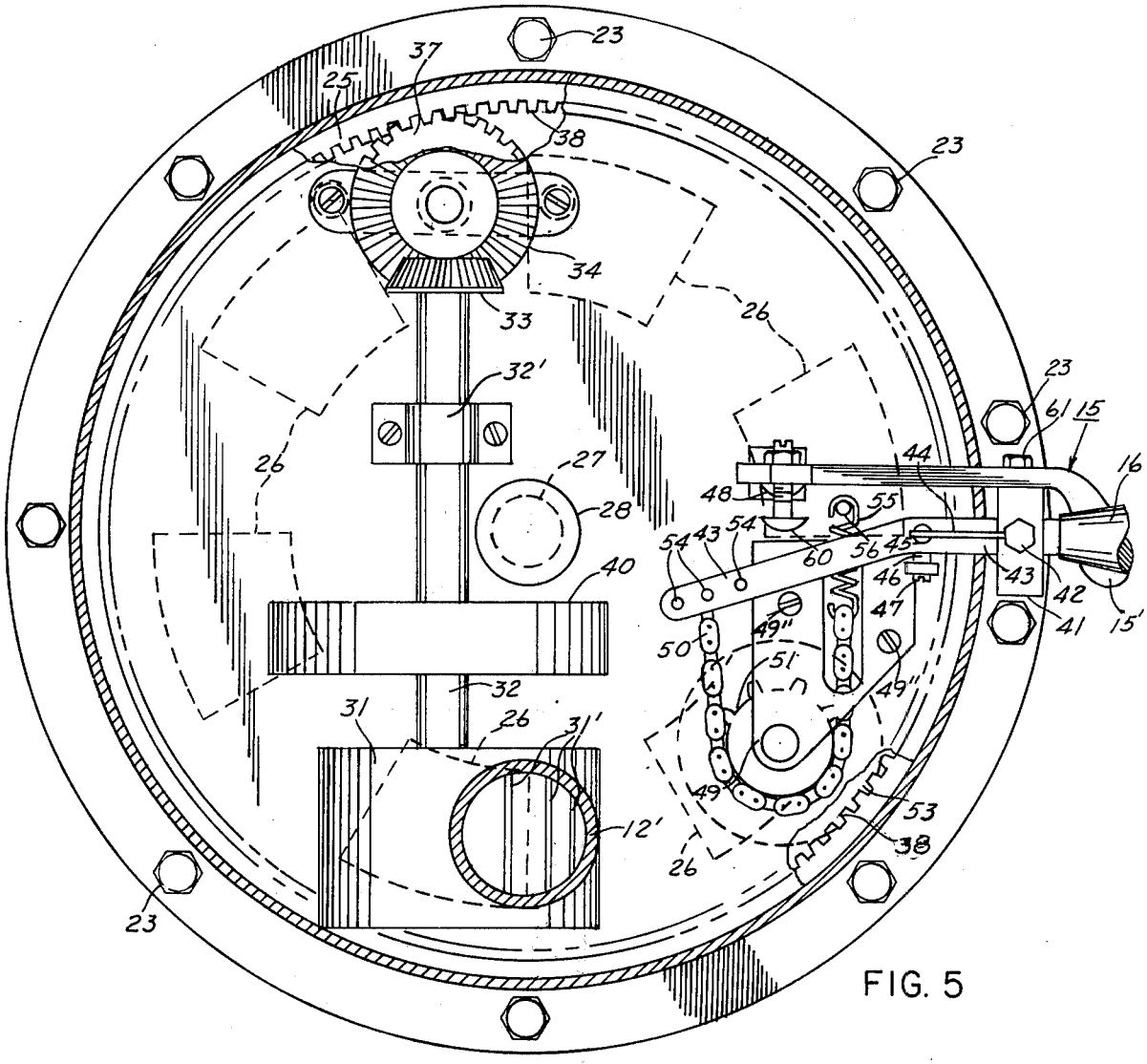
FIG. 5 is an enlarged sectional elevation view taken along the line 5—5 of FIG. 3 and partly broken away.

The actuating mechanism of the valve arranged within the housing 10 is illustrated somewhat diagrammatically in FIGS. 4 and 5. The valve member which controls the passage of water from the inlet 12 to the outlet 12' is a disc or plate 24 which has a peripheral flange 25 extending rearwardly toward the plate 20. The valve disc 24, as shown in FIG. 5, has a plurality of openings 26 each of the same size and formed with straight radial edges extending between radially spaced arcuate edges. The number of openings 26 will vary according to the design and six openings have been shown merely by way of example. The openings 26 are spaced at equal angular intervals and the solid portions of the disc between the openings are of sufficient length to extend across and completely close the outlet 12'. In FIG. 5, an opening 26 is shown in position to uncover about one half of the area of the outlet. The valve disc 24 is rotatably mounted on a shaft 27, which is freely rotatable within a sealed bearing 28, securely mounted on the opposite side of the plate 20. A sealing ring 30 is mounted on the inner surface of the dished portion 17 of the casing 11 about the outlet 12'. The seal frictionally engages the face of the valve disc 24 when any one of the solid portions of the disc is in position to extend across and close the outlet 12', the pressure difference pressing the disc toward the seal. The disc 24 is connected as described below to be rotated by operation of the handle 16, so that by operation of the handle one of the openings 26 is moved into position with its leading radial edge beyond the near edge of the opening to uncover a portion of the opening and provide communication with outlet 12', so that water flows from the inlet 12 to the outlet 12'. The water flows through the cylindrical casing of a water motor 31 diagrammatically illustrated as having a wheel provided with a multiplicity of blades 31' shown in FIG. 5. The water motor wheel is mounted to rotate its shaft, indicated at 32, which drives a bevel gear 33. The gear 33 meshes with and drives a bevel gear 34 in a clockwise direction, as viewed in FIG. 5; the gear 34 is mounted on a shaft 35 which extends through a water seal bearing 36 and meshes with and drives a gear 37 which meshes with a ring gear 38 provided on the inner side of flange 25 of the disc 24. This drives the ring gear 38 clockwise, as viewed in FIG. 5. The shaft 32 turns in a bearing 32' rigidly supported on a post 32'', which is firmly secured to the plate 20. The wheel of the water motor 31 continues to turn while water is supplied through the conduit 12 until the disc 24 moves sufficiently far that its trailing radial edge reaches the far edge of the opening to close the outlet 12', whereupon the disc stops. A fly wheel 40 is mounted on the shaft 32 and assures a continuation of the movement of the disc 24 when the flow of water is diminished as the trailing edge approaches the far side of the outlet port 12' until the outlet port is closed. When the disc stops the outlet 12' is closed and the pressure of the water within the capsule 11 seals the valve plate 24 against the sealing ring 30. It will be understood that the capsule 11 is filled with water under pressure at all times because the water supply is in open communication with the interior of the capsule through the outlet of the motor indicated at 31'' in FIG. 4. The features of construction thus far described are the same as those of my above-identified copending application.

Figure 6:
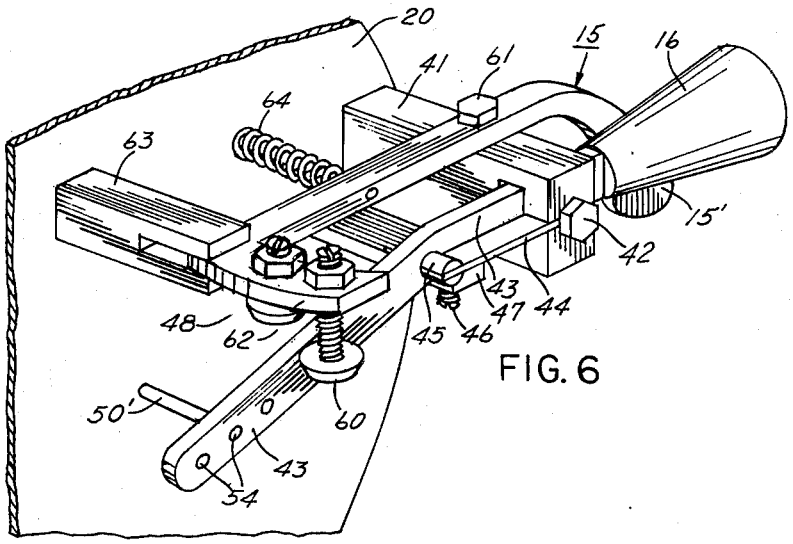
FIG. 6 is an isometric view of a portion of the valve.

As shown in FIGS. 5 and 6, the actuator handle 16 is mounted on a block or post 41 and is pivoted on a bolt 42 threaded into the block. The block 41 is welded or otherwise rigidly secured to the base plate 20 of the valve capsule 11. The handle is rigidly secured to a bar 43, which comprises a straight portion extending inwardly from the handle and then bent downwardly, as shown in FIG. 5. The bar 43 is biased to its normal position by a flat spring 44, which is rigidly attached to the block 41 at its outer end and slidably engages a bifurcated pin 45 on the bar 43. The spring preferably holds the bar 43 normally against an adjustable stop 46 mounted in a post 47 extending from the plate 20. Thus, the handle may be moved downwardly but may not be raised because of the stop 46.

The handle 16, upon being depressed, moves the sloping portion of the bar 43 upwardly until it engages a spherical surfaced stop 48. This effects a rotation of the ring gear, and thus the disc 24, and opens the valve a substantial distance to allow the water to flow and drive the motor 31 until it closes the valve and stops the flow of water. The movement of the handle 16 is transmitted to the disc through a sprocket chain 50, a sprocket wheel or gear 51, a rachet-type clutch 52, and a gear 53 to the ring gear 38. The sprocket is rotatably mounted in a plate 49 supported from the plate 20 on posts, one of which is shown at 49', the plate being secured by machine screws 49''. Thus, when the handle is depressed, the bar 43 43 rises and pulls the sprocket chain to turn the sprocket clockwise thereby rotating the ring gear in the clockwise direction as viewed in FIG. 5. The sprocket chain is pivotally attached to a projecting pin 50' near the end of the bar 43 at one of several holes 54, it being shown at the middle hole. A plurality of holes are provided for adjusting the amount of movement of the chain by selecting the hole 54 at which the pin 50' is attached by a threaded connection. When the handle is released, it is returned to its normal position by the spring 44 and a helical spring 55, which draws the chain 50 back to its starting position, the ratchet 52 allowing this movement without movement of the gear 38 and disc 24. The clutch comprises two separate parts 57 and 58 connected to rotate with sprocket 51 and to drive gear 53, respectively. The ratchet 52 is keyed to but slidable along the shaft 51' of the sprocket. The two parts are pressed together by a spring 59, which allows the parts to be released upon reverse movement. The spring 55 is connected to the chain at one end and to a post 56 at its other end; the post 56 is attached to and extends outwardly from the plate 20. When the water flows, the motor drives the disc 24 and the ratchet clutch allows the movement of the disc without driving the sprocket.

The normal movement of the bar until it engages the stop 48 provides the small or partial flush opertion. When a full flush is required, the outer end 15' of the auxiliary control lever 15 is pressed toward the handle 16 before the handle is operated and, upon operation of the handle, the bar 43 strikes a stop 60, which limits the sprocket chain to a shorter length of movement and produces a lesser opening of the valve. The motor, therefore, must operate a longer time to close the valve and the full quantity flush is produced. The full flush operation thus requires the operator be conscious of operation of the lever 15 by first pressing the outer end 15' toward the handle 16, and in the usual course of operation a larger number of operations will be accomplished by use of the handle alone, thus effecting a saving of water.

The construction and arrangement of the auxiliary lever 15 is shown in FIGS. 5 and 6. The lever is pivotally mounted on a vertical axis on the top side of the block 41 by a bolt 61 and has an arcuate end or foot 62 which is slidable in a bifurcated post 63. The foot 62 slides between the top and bottom portions of the post, and this structure, together with the pivoted mounting of the lever 15 on the block 41, provides a rigid support for the stops 48 and 62, both of which are mounted on threaded shafts on the foot. The lever 15 thus may swing in a horizontal plane from its outer position, as shown, to an inner position against the inner end of the slot in the block 63. The lever 15 is biased to hold its outer end 15' away from the handle 16 by a spring 64, which is mounted between the lever and the plate 20. When the outer end of the lever 15 is held toward the handle 16 during operation of the handle, the stop 60 is directly above the bar 43 and this operation results in the full flush. The positions of the stops 48 and 60 may be adjusted to the desired quantities of flow for each of the high and low flush positions.

Access to the interior of the housing 10 is attained by removing the screws 23 and drawing the cover away from the capsule 11 back along the straight inlet pipe, a suitable slot (not shown) to accommodate movement past the handle 16 and lever 15 being provided in the housing. After removal of the housing, the control within the housing may be adjusted or otherwise serviced. For close quarter installations, the housing may be made in two parts bolted together along the center horizontal plane of the pipe 12 to afford ready release of the housing after movement away from the handle.

For some applications, it may be desirable to provide a more positive stop position for the disc 24 and a detent 65 and a recess 66 with sloping sides has been shown in the lower portion of FIG. 4, the detent 65 being secured to the plate 20 in any suitable manner at 67. The detent is positioned to engage the recess 66, when the valve disc 24 moves to a position in which the solid area of the disc between two openings has closed the opening 12'. A plurality of recesses 66 are provided, one for each of the openings 26, so that the detent enters the corresponding recess for each of the openings. The detent is effective when the water flow has decreased to a minimum and holds the disc in position ready for the next operation of the handle or actuator 16, which releases the detent by a movement of the disc 24.

The adjustment of the relative amounts of the high volume flow and the low volume flow may be made by removing the housing for access and changing of the positions of the stops 48 and 60, and in some cases by changing the point of connection of the sprocket chain to the arm 43. This provides a wide range of adjustment, so that the quantity of flow for operation of the handle 16 with and without the use of the lever 15 may be selected, as desired. The provision of the low volume flow for a large portion of the number of operations of the valve acts to save water by decreasing the use of water in excess of that required.

While I have described my invention in connection with a specific embodiment, various modifications and arrangements will occur to those skilled in the art. I do not, therefore, desire my invention to be limited to the details shown and described, and I intend by the appended claims to cover all modifications which fall within the spirit and scope of my invention.

I clain:

1. A dual capacity flush valve comprising a closed casing having a water inlet and a water outlet, a valve member movable from a fully closed position to a fully open position, means providing a water passage between said inlet and said outlet and a water motor positioned within said passage for rotation by water passing therethrough, means connecting said motor to drive said valve member in a predetermined direction, and actuator for selectively moving said valve member to a first open position and alternatively to a second more open position, said actuator upon moving said valve member to either of said positions effecting the supplying of water to said motor for driving said valve member to its closed position whereby movement of said member to said first position allows a greater volume of water to flow before closing said valve than that resulting from the movement of said valve member to said second position, said actuator comprising a handle normally effective to move said valve member to said second position and separate selectively operatable manual means for affording movement of said handle to effect movement of said valve member to said first position.

2. A dual capacity flush valve as set forth in claim 1, wherein said handle is movable in the same direction for effecting movement of said valve member to both said positions, and wherein said manual means includes a movable stop and a selector element mounted adjacent said handle for moving said stop into the path of movement of said actuator for stopping movement of said valve member in said second position.

3. A dual capacity flush valve as set forth in claim 1, wherein said actuator comprises a handle and means biasing the handle to its starting position, a first stop for normally stopping movement of said handle when said valve member is in said second position, a second stop and means adjacent said handle for moving said second stop into position for stopping movement of said handle when said valve member is in said first position.

4. A dual capacity flush valve as set forth in claim 1, wherein said actuator is normally effective to move said valve member to said second open position, a movable stop for said actuator, and means for interposing said stop in the path of said actuator to stop movement of said valve member in said first position.

5. A dual capacity flush valve as set forth in claim 4, wherein said actuator includes a handle projecting from said casing and said stop interposing means includes a movable element adjacent said handle for actuation by the operator upon gripping the handle.

6. A dual capacity flush valve as set forth in claim 4, wherein said actuator includes a handle projecting from said casing, and selector means adjacent said handle for actuating said stop interposing means.

7. A dual capacity flush valve as set forth in claim 5, wherein said handle is pivoted on a fixed axis for movement in a single plane and said movable element of said interposing means is pivoted on an axis transverse to that of said handle.

8. A dual capacity flush valve as set forth in claim 7, wherein said fixed axis is horizontal and said transverse axis is vertical.

* * * * *